United States Patent [19]

Lorenzen et al.

[11] Patent Number: 4,651,754

[45] Date of Patent: Mar. 24, 1987

[54] APPARATUS FOR BUILDING A STREAM FROM PARTICLES OF SMOKABLE MATERIAL

[75] Inventors: Heinz-Christen Lorenzen, Wentorf; Uwe Heitmann, Hamburg; Wolfgang Steiniger, Börnsen, all of Fed. Rep. of Germany

[73] Assignee: Hauni-Werke Körber & Co. KG., Hamburg, Fed. Rep. of Germany

[21] Appl. No.: 666,283

[22] Filed: Oct. 29, 1984

[30] Foreign Application Priority Data

Nov. 2, 1983 [DE] Fed. Rep. of Germany ..... 3339554

[51] Int. Cl.[4] ..... A24C 5/14; A24C 5/18

[52] U.S. Cl. ..... 131/84.3; 131/84.1

[58] Field of Search ..... 131/84.1, 84.2, 84.3, 131/84.4, 108, 109.1

[56] References Cited

U.S. PATENT DOCUMENTS

| | | | |
|---|---|---|---|
| Re. 29,042 | 11/1976 | David | 131/84 B |
| 3,736,941 | 6/1973 | Molins et al. | 131/84 B |
| 4,185,644 | 1/1980 | Heitmann et al. | 131/109.1 |
| 4,249,544 | 2/1981 | Reuland et al. | 131/84.1 |
| 4,423,742 | 1/1984 | Reuland | 131/84.4 |

*Primary Examiner*—V. Millin

*Attorney, Agent, or Firm*—Peter K. Kontler

[57] ABSTRACT

The duct which delivers tobacco shreds to the underside of the lower reach of an air-permeable belt conveyor contains a guide with a concave surface which tapers gradually toward the underside of the lower reach, as considered in the direction of advancement of the lower reach. A nozzle discharges a current of compressed air against the concave surface so that the current flows along the concave surface toward the underside of the lower reach in the aforementioned direction and entrains the particles which tend to impinge upon the concave surface so that the current and the particles therein form a fluidized bed which is delivered to the underside of and is attracted to the lower reach because the upper side of the lower reach is adjacent to a suction chamber. The particles which are entrained by the current deposit on the lower reach gently and do not clog the interstices of such lower reach so that the latter can attract additional tobacco particles, either from one or more additional fluidized beds or directly from the duct. This reduces the likelihood of comminution of tobacco particles on impact against the lower reach of the conveyor as well as excessive and premature clogging of the interstices of the lower reach with tobacco shreds. That portion of the current which advances beyond the downstream end of the concave surface flows at least substantially in parallelism with the direction of advancement of the lower reach.

13 Claims, 2 Drawing Figures

APPARATUS FOR BUILDING A STREAM FROM PARTICLES OF SMOKABLE MATERIAL

BACKGROUND OF THE INVENTION

The present invention relates to apparatus for building a stream from particles of smokable material, particularly tobacco shreds. More particularly, the invention relates to improvements in apparatus of the type wherein the stream is formed on an air-permeable conveyor which attracts the particles by suction and moves the particles within a channel having two sidewalls and a bottom wall constituted by the air-permeable conveyor.

It is known to deliver tobacco shreds into the aforementioned channel by way of a duct which receives particles from a mechanical propelling device (such as a rapidly driven carded drum) or in a current of air or another gaseous carrier medium.

Heretofore known stream building apparatus of the above outlined character operates satisfactorily as long as the speed of the conveyor which attracts the particles coming from the duct is below a certain value. However, once such speed is exceeded, the quality of the stream deteriorates and the deterioration progresses as the speed of the conveyor continues to rise. One of the main reasons for deterioration of the quality of the stream of accumulated particles when the speed of the air-permeable conveyor rises above a threshold value, or above a range of threshold values, is that the particles must be fed into the range of the conveyor at a very high speed in order to ensure the formation of a stream containing the required quantity of smokable material per unit length. The particles which are propelled against one side of the rapidly moving air-permeable conveyor (e.g., against the outer side of the upper or lower reach or run of an endless belt conveyor) immediately clog the majority of interstices in the conveyor at the locus or loci of impingement so that the force with which the conveyor attracts the next-following particles is but a small fraction of the initial force (prior to partial clogging). Consequently, the density of the layer which is immediately adjacent to the air-permeable conveyor is much more pronounced than the density of the remaining layer or layers. This results in the making of an unsatisfactory tobacco filler, i.e., the density of such filler is not constant but varies pronouncedly as considered at right angles to its axis. This evidently affects the quality of the ultimate products such as plain or filter tipped cigarettes, cigars or cigarillos.

Another serious drawback of the above described conventional apparatus is that, once the speed of the conveyor (and hence the velocity of particles which are fed to the conveyor) rises above a certain value, the particles are likely to break on impact upon the conveyor so that the apparatus produces a high percentage of so-called short tobacco which also detracts from the quality of the ultimate products and is even more likely to clog the interstices of the air-permeable conveyor. The likelihood of the formation of a high percentage of short tobacco is especially pronounced in that part of the stream building zone where successive increments of the rapidly moving air-permeable conveyor are first contacted by the particles of smokable material, i.e., where the particles impinge directly upon the conveyor rather than upon particles which are already attracted to the conveyor.

OBJECTS AND SUMMARY OF THE INVENTION

An object of the invention is to provide a novel and improved apparatus for forming a stream from tobacco shreds and/or other particles of smokable material which can build a satisfactory stream at the speed that is required in a modern cigarette rod making or like machine in such a way that the density of each and every portion of the stream matches or closely approximates the desired density.

Another object of the invention is to provide an apparatus which forms the stream without any or without appreciable comminution of delivered particulate material.

A further object of the invention is to provide an apparatus which treats the particles gently and which can effect a desirable stratification of delivered particles with optimum orientation of particles in each layer.

An additional object of the invention is to provide an apparatus which can be used as a superior substitute for presently known stream building apparatus in cigarette rod making and analogous machines.

Another object of the invention is to provide the apparatus with novel and improved means for supplying particles of smokable material into the stream building zone and for influencing the trajectories of such particles before they reach the stream building zone.

Still another object of the invention is to provide the apparatus with novel and improved means for guiding the particles on their way toward the stream building zone.

An additional object of the invention is to provide a novel and improved method of building a continuous homogeneous stream from shreds of tobacco leaves or the like.

The invention resides in the provision of an apparatus for building a stream from particles of smokable material, particularly tobacco shreds. The apparatus comprises an air-permeable driven belt conveyor including an elongated reach which can but need not be substantially horizontal and advances in a predetermined direction and has a first side and a second side, means for establishing a pressure differential at the opposite sides of the reach so that air flows from the first side, through the reach and beyond the second side, a guide which is adjacent to the first side of the reach and has a concave surface tapering (preferably gradually) toward the first side, as considered in the direction of advancement of the reach, a source of compressed air which serves to discharge a current of compressed air against the concave surface of the guide so that the current which issues from the source flows along the concave surface and toward the first side with a component of flow in the direction of advancement of the reach, and particle supplying means including a device which feeds particles into the current of compressed air so that the latter entrains such particles in the form of a fluidized bed toward the first side and the thus entrained particles are attracted to and advance with the reach. The curvature of the concave surface of the guide is preferably such that the component of flow in the direction of advancement of the reach increases along successive increments of the concave surface, as considered in the direction of advancement of the reach, and the direction of flow of the major part of or the entire current at least substantially coincides with the direction of advancement of the reach not later than when the current of compressed air and the particles of smokable material therein advance beyond the concave surface.

The apparatus preferably further comprises two elongated sidewalls which flank the reach and extend beyond the first side of such reach to form therewith a channel with a permeable bottom. The current of compressed air delivers particles of smokable material into the space between the two sidewalls. The aforementioned device of the particle supplying means can constitute a duct which admits particles into the current of compressed air and preferably also directly against the first side of the reach downstream of the concave surface of the guide. The guide can form an integral or a detachable part of the duct and is preferably disposed in the upstream part of the duct, as considered in the direction of advancement of the reach. As a rule, or at least in many instances, the guide will be located adjacent to the rearmost part of the reach of the air-permeable conveyor.

The apparatus can further comprise at least one additional guide which is located downstream of the concave surface of the first mentioned guide, as considered in the direction of advancement of the reach, and has an additional concave surface which tapers toward the first side of the reach, as considered in the direction of advancement of the reach. Such apparatus then further comprises an additional source of compressed air which discharges an additional current of compressed air against the additional concave surface so that the additional current flows along the additional concave surface toward the first side of the reach with a component of flow in the direction of advancement of the reach, and additional particle supplying means including an additional device for feeding particles of smokable material into the additional current so that the latter entrains such particles toward the first side and the thus entrained particles are attracted to and advance with the reach and overlie the layer of particles which are supplied by the first mentioned current. The two devices can form part of a single duct. The discharge end of the first mentioned concave surface is disposed at a first distance from the first side of the reach and the discharge end of the additional concave surface is disposed at a greater second distance from the first side of the reach. This ensures that the additional guide cannot interfere with the progress of particles from the discharge end of the first mentioned concave surface toward the station where the material which accumulates at the first side of the reach is converted into the filler of a cigarette rod or the like.

The aforementioned reach can constitute the lower reach of the endless conveyor, and the first side is preferably the underside of such lower reach. The pressure differential establishing means can include an elongated suction chamber which is adjacent to the upper side of the lower reach.

Each source of compressed air can comprise a suitably configurated and oriented nozzle (e.g., a nozzle having a battery of air-discharging orifices) which directs the respective current of compressed air against the respective concave surface and has an outlet which discharges the current in a direction that is at least substantially parallel to the adjacent portion of the respective concave surface.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
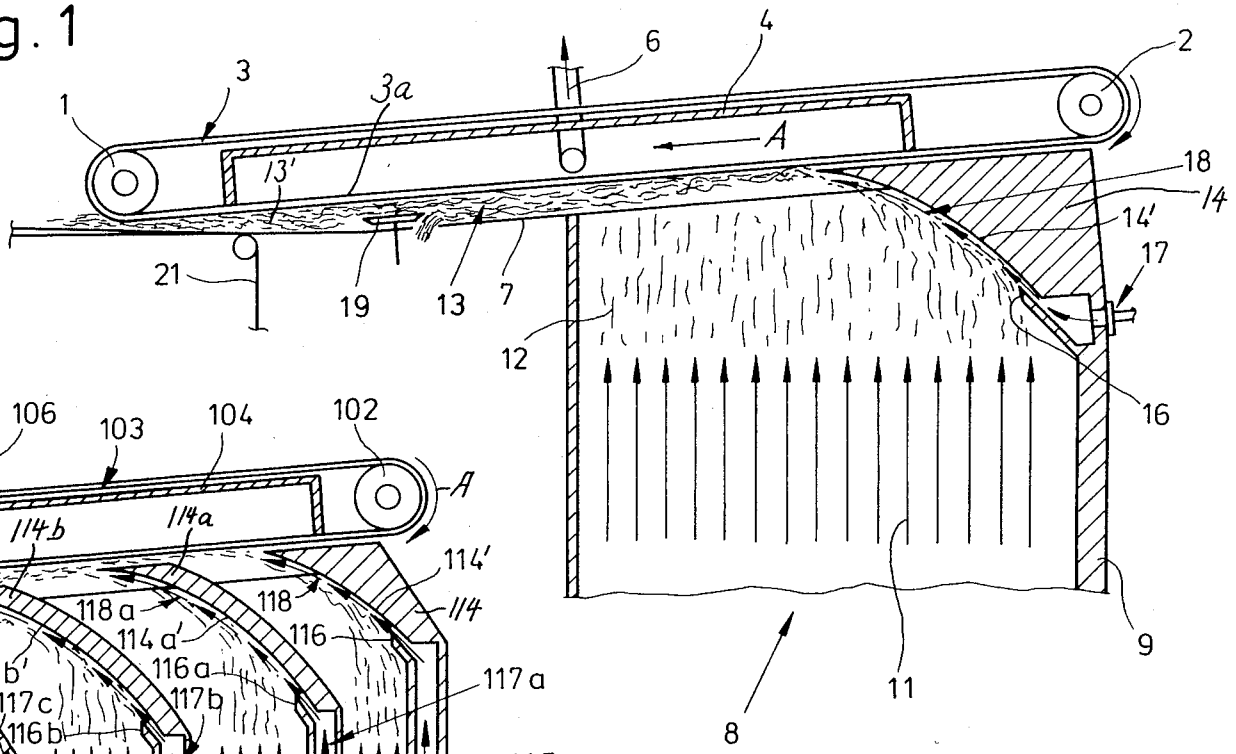
FIG. 1 is a partly side elevational and partly longitudinal vertical sectional view of a stream building apparatus which embodies one form of the present invention and comprises a single guide.

Referring first to FIG. 1, there is shown an apparatus which serves to build a continuous homogeneous stream 13 from particles 12 of smokable material. Such particles can include tobacco shreds or otherwise configurated fragments of tobacco leaves, shreds made from sheets of reconstituted tobacco, substitute tobacco or a mixture of the above. The apparatus is installed in a cigarette rod making machine having a customary distributor (such as the one disclosed in commonly owned U.S. Pat. No. 4,185,644 granted Jan. 29, 1980 to Heitmann) which delivers a shower of particles 12 (e.g., tobacco shreds) into the lower portion of a tobacco supplying device 8 having a narrow duct 9 for delivery of particles 12 in the directions which are indicated by arrows 11. Such particles ultimately reach and adhere to the underside of the lower reach 3*a* of an endless air-permeable belt conveyor 3 which is trained over pulleys 1 and 2. At least one of the pulleys 1 and 2 is driven so that the lower reach 3*a* advances in the direction which is indicated by the arrow A. The upper side of the lower reach 3*a* is adjacent to the open underside of a stationary suction chamber 4 having an outlet 6 which is connected to the suction intake of a blower (not shown) or another suitable suction generating device. The suction chamber 4 establishes a pressure differential between the opposite sides of the lower reach 3*a* so that air is induced to flow toward the underside, through the lower reach 3*a* and beyond the upper side (i.e., into the suction chamber 4) to thereby attract the particles 12 by suction. The lower reach 3*a* constitutes the bottom wall of an inverted U-shaped channel having two elongated spaced-apart parallel sidewalls 7 which flank the marginal portions of the lower reach 3*a*, which extend downwardly beyond the underside of the lower reach, and of which only one is actually shown in FIG. 1. The means for causing the particles 12 to rise in the duct 9 can comprise a rapidly rotating carded drum (not shown) and/or a source of compressed air or another gas which supplies a gaseous carrier medium for the propagation of particles 12 in the direction of arrows 11.

In accordance with a feature of the invention, the improved stream building apparatus further comprises a guide 14 which is removably installed in or (as actually shown) forms an integral part of the duct 9 and has a concave surface 14' serving to guide a certain percentage of rising particles 12 along an arcuate path toward the underside of the lower reach 3*a*. The guide 14 is provided in the upstream portion of the duct 9, as considered in the direction of arrow A, i.e., it is closely adjacent to the rearmost portion of the lower reach 3*a* immediately downstream of the pulley 2. This guide cooperates with a source 17 of compressed air, e.g., with a plenum chamber which receives compressed air from the discharge end of a blower or the like, not shown. The source 17 includes a nozzle 16 which discharges a current of compressed air against the concave surface 14' in a region which is remote from the lower reach 3a and in such a way that the current flows along the surface 14' and toward the underside of the lower reach 3a, i.e., toward the actual stream building zone of the apparatus. The orientation of the nozzle 16 is preferably such that the current or currents issuing from its orifice or orifices first flow in exact parallelism with the adjacent portion of the surface 14' and thereupon continue to flow along the surface 14' all the way to and beyond the discharge end of the guide 14. The taper of the surface 14' relative to the underside of the lower reach 3a is such that the current issuing from the nozzle 16 has a growing component of movement in the direction which is indicated by the arrow A and that at least the major part of the current flows in the direction of arrow A not later than when successive increments of the current reach the wedge-like discharge end of the guide 14.

The particles 12 which are delivered by the right-hand portion of the duct 9 (namely the upstream portion, as considered in the direction indicated by the arrow A) enter the current of compressed air that issues from the nozzle 16 and form therewith a fluidized bed 18 which flows close to and along the surface 14' toward the underside of the lower reach 3a. Since each particle 12 which is delivered to the lower reach of the conveyor 3 in the current of compressed air issuing from the nozzle 16 has a substantial component of movement in the direction of arrow A before such particle reaches the underside of the lower reach 3a, the transfer of the particle from the current onto the lower reach 3a (under the influence of the pressure differential which is established by the suction chamber 4) is gentle and does not result in breakage of particles and pronounced clogging of the interstices of the lower reach 3a even if the latter advances at a very high speed, e.g., at a speed which is necessary in a modern cigarette rod making machine designed to turn out up to and even in excess of 8000 plain cigarettes per minute. Thus, the current of air issuing from the nozzle 16 ensures that the trajectory of each particle 12 which forms part of the fluidized bed 18 is at least substantially parallel to the direction which is indicated by the arrow A not later than when the respective particle reaches the discharge end of the guide 14. Consequently, the apparatus which is shown in FIG. 1 forms at the underside of the lower reach 3a a relatively soft topmost layer of the stream 13. The remainder of the stream 13 is formed by particles 12 which rise in the left-hand portion of the duct 9 so that they reach the lower reach 3a downstream of the guide 14. The relatively soft topmost layer of particles 2 does not appreciably affect the ability of the suction chamber 4 to draw air through the lower reach 3a so that the layer or layers which are formed by particles 12 that deposit directly on the layer of particles 12 from the fluidized bed 18 can be properly densified by suction and the density of the fully grown stream 13 is surprisingly uniform all the way from the underside of the lower reach 3a to the underside of the fully grown stream 13.

The lower reach 3a of the conveyor 3 advances the fully grown stream 13 past a conventional trimming or equalizing device 19 which removes the surplus from the underside of the stream 13 so that the thus obtained filler 13' is ready to be draped into a web 21 of cigarette paper or other suitable wrapping material in a manner which forms no part of the present invention. Reference may be had, for example, to commonly owned U.S. Pat. No. 4,249,544 granted Feb. 10, 1981 to Reuland et al. The details of a trimming device which can be used in the apparatus of FIG. 1 to remove the surplus from the stream 13 are disclosed, for example, in U.S. Pat. No. 4,423,742 granted Jan. 3, 1984 to Reuland. The filler 13' is densified during draping of the web 21 therearound and the marginal portions of the web are bonded to each other by a suitable adhesive so that the draped web 21 and the densified filler 13' constitute a continuous cigarette rod which is severed at regular intervals by a conventional cutoff to yield plain cigarettes of unit length or multiple unit length. The means for drawing the web 21 and the filler 13' through the wrapping station comprises a customary endless belt conveyor which is not shown in the drawing.

The speed of the conveyor 3, of compressed air issuing from the nozzle 16 and of the particles 12 which ascend in the duct 9 will be selected in dependency on a plurality of parameters, such as the desired output of the machine which embodies the improved stream forming apparatus, the desired quantity of particles per unit length of the stream 13 and others. For example, the speed of the particles 12 in the duct 9 will normally conform to and vary with the speed of the conveyor 3, and the same preferably applies for the speed of the current of compressed air which issues from the nozzle 16. By way of example, the particles 12 which are delivered to the underside of the lower reach 3a of the conveyor 3 in the fluidized bed 18 can constitute approximately 10 percent of the total quantity of smokable material which is needed to form the fully grown stream 13. The remainder of the particles 12 is delivered into the stream building zone downstream of the guide 14, as considered in the direction of arrow A.

While it is also possible to install the guide 14 in the left-hand portion of the duct 9, as viewed in FIG. 1, the illustrated mounting of the guide in the upstream portion of the duct is preferred because the permeability of the lower reach 3a is affected primarily by those particles 12 which are first to reach its underside. Thus, the particles 12 which are delivered in the fluidized bed 18 are first to reach the underside of the lower reach 3a and, due to their aforediscussed trajectories in the region of the discharge end of the guide 14, such particles form a rather soft layer which not only reduces the likelihood of the formation of short tobacco but also does not appreciably affect the ability of the lower reach 3a and suction chamber 4 to attract the remaining particles 12 which are needed for a stream 13 of satisfactory cross-sectional area and density. The fact that the particles 12 which are not delivered in the fluidized bed 18 may or do impinge upon the topmost layer in a direction substantially at right angles to the longitudinal direction of the lower reach 3a does not adversely affect the quality of the stream because the impact of such particles is cushioned by those which form the relatively soft topmost layer, i.e., the particles which advance in the duct 9 directly into the stream building zone (rather than into the current of compressed air issuing from the nozzle 16) cannot impinge directly upon the lower reach 3a but must impinge upon a yieldable buffer or barrier which is formed by the topmost layer of particles 12.

An important advantage of the improved apparatus is that it contributes to the formation of a stream 13 whose density is much more uniform in each and every portion thereof than the density of streams which are formed in heretofore known apparatus. This is due to the fact that at least a certain percentage of particles 12 is caused to advance along a path that is at least substantially parallel to the lower reach 3*a* of the conveyor 3 not later than in the region (to the left of the guide 14) where the particles 12 in the fluidized bed 18 are caused to adhere to the underside of the lower reach 3*a* under the action of suction in the chamber 4. The transfer from the gaseous carrier medium that issues from the nozzle 16 to the underside of the lower reach 3*a* is gradual and gentle so that the formation of short tobacco is minimal which also contributes to the predictability of densification of particles by suction on their way toward the trimming station. The quality of the stream 13 is highly satisfactory not only because the density of such stream is uniform but also because the stream contains a very low percentage of short tobacco; this contributes to the firmness of the filler in the cigarette rod.

Figure 2:
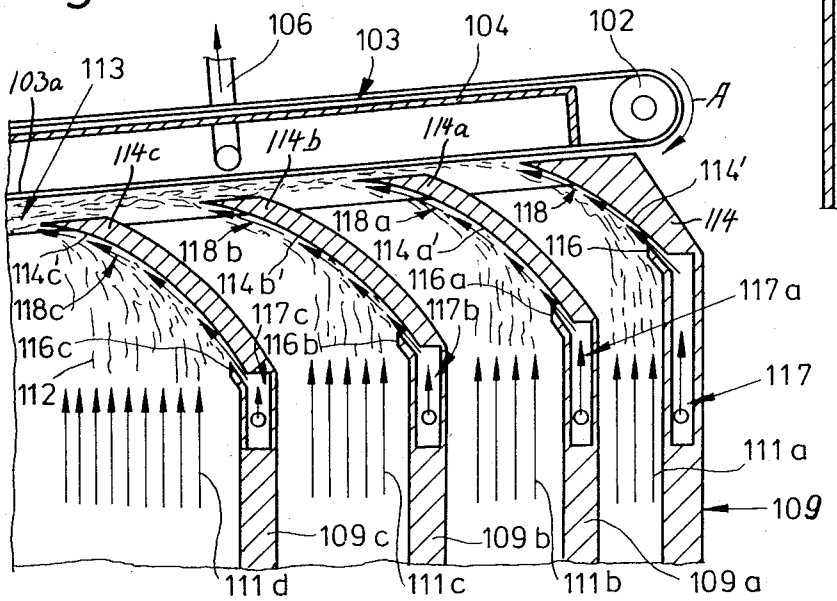
FIG. 2 is a fragmentary partly side elevational and partly longitudinal vertical sectional view of a modified apparatus with a series of four successive guides.

FIG. 2 shows a portion of a modified stream building apparatus wherein all such parts which are identical with or clearly analogous to the corresponding parts of the apparatus of FIG. 1 are denoted by the same reference characters plus 100. The duct 109 of the particle supplying means contains three partitions 109*a*, 109*b*, 109*c* which divide its interior into four vertical or nearly vertical passages for particles 112 flow in the directions respectively indicated by arrows 111*a*, 111*b*, 111*c* and 111*d*. Such passages are disposed downstream of one another, as considered in the direction (arrow A) of advancement of the lower reach 103*a* of the endless air-permeable belt conveyor 103. The upper end portion of the right-hand wall of the duct 9 is integral with (as shown) or is separably connected with a first guide 114 having a concave surface 114', and the upper end portions of the partitions 109*a*–109*c* are respectively rigid with three additional guides 114*a*, 114*b*, 114*c* which have concave surfaces 114*a'*, 114*b'*, 114*c'*. The discharge ends of the guides 114–114*c* are disposed at different distances from the underside of the lower reach 103*a* of the conveyor 103 so as to ensure that the layer which is formed by particles 112 delivered in the fluidized bed 118 can advance above the next-following guide 114*a*, that the layers formed by particles 12 delivered by the fluidized beds 118, 118*a* can pass above the guide 114*b*, and that the layers formed by the particles 12 which are delivered by the fluidized beds 118, 118*a*, 118*b* can pass above the guide 114*c*. Thus, the distance between the underside of the lower reach 103*a* and the guides 114, 114*a*, 114*b*, 114*c* increases as considered in the direction of advancement of the lower reach 103*a*. In the apparatus of FIG. 2, the entire stream 113 can be assembled exclusively or nearly exclusively of particles 112 which are delivered by the streams of compressed air issuing from the four nozzles 116, 116*a*, 116*b*, 116*c*. Such nozzles receive compressed air from the respective sources 117, 117*a*, 117*b*, 117*c* which, in turn, can receive compressed air from a common plenum chamber or from a series of discrete plenum chambers. The thicknesses of the layers which are formed by the particles 112 delivered in the four fluidized beds 118, 118*a*, 118*b*, 118*c* may be the same or such thicknesses can vary from layer to layer. The curvature of all four surfaces 114–114*c'* may but need now be the same, as long as each of the four guides 114–114*c* ensures that the respective particles 112 will have pronounced components of movement in the direction of arrow A not later than when they reach the discharge ends of the respective guides. It has been found that the homogeneousness of the stream 113 which is built from several strata is highly satisfactory and that the quantity of short tobacco (attributable to impingement of particles 112 upon the lower reach 103*a*) is practically nil.

The duct 109 can extend to the left beyond the guide 114*c* so that a portion of the layer 113 is formed by particles which are not delivered by currents of compressed air.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for building a stream from particles of smokable material, particularly tobacco shreds, comprising an air-permeable driven belt conveyor including an elongated reach arranged to advance in a predetermined direction and having a first side and a second side; means for establishing a pressure differential at the opposite sides of said reach so that air flows from said first side, through and beyond the second side of said reach; a guide adjacent to the first side of said reach and having a concave surface sloping toward said first side, in said direction; a source of compressed air arranged to discharge a current of compressed air against said concave surface so that the current issuing from said source flows along said concave surface and toward said first side with a component of flow in said direction; and particle supplying means including a device for feeding particles into said current so that the latter entrains such particles toward said first side and the thus entrained particles are attracted to and advance with said reach.

2. The apparatus of claim 1, wherein the curvature of said surface is such that said component of flow grows along successive increments of said surface, as considered in said predetermined direction, and the direction of flow of the major part at least of said current substantially coincides with said predetermined direction not later than when the current advances beyond said surface.

3. The apparatus of claim 1, further comprising two elongated sidewalls flanking said reach and extending beyond said first side, said current being arranged to deliver the particles into the space between said sidewalls.

4. The apparatus of claim 3, wherein said device of said particle supplying means comprises a duct which admits particles into said current as well as directly against the first side of said reach downstream of said surface, as considered in said predetermined direction.

5. The apparatus of claim 4, wherein said guide forms part of said duct.

6. The apparatus of claim 4, wherein said duct includes an upstream portion and downstream portion, as considered in said predetermined direction, and said guide is disposed in the upstream portion of said duct.

7. The apparatus of claim 1 wherein said guide is adjacent to rearmost part of said reach, as considered in said predetermined direction.

8. The apparatus of claim 1, further comprising at least one additional guide located downstream of said concave surface, as considered in said direction, and having an additional concave surface tapering toward said first side, as considered in said direction, an additional source of compressed air arranged to discharge an additional current of compressed air against said additional concave surface so that the current issuing from said additional source flows along said additional concave surface and toward said first side with a component of flow in said predetermined direction, and additional particle supplying means including an additional device for feeding particles into said additional current so that the latter entrains such particles toward said first side and the thus entrained particles are attracted to and advance with said reach and overlie the particles which are supplied by said first mentioned current.

9. The apparatus of claim 8, wherein said devices form part of a single duct.

10. The apparatus of claim 8, wherein said first mentioned concave surface has a discharge end disposed at a first distance from the first side of said reach and said additional concave surface has a discharge end disposed at a greater second distance from the first side of said reach.

11. The apparatus of claim 1, wherein said reach is the lower reach of said conveyor and said first side is the underside of said lower reach.

12. The apparatus of claim 11, wherein said pressure differential establishing means comprises a suction chamber adjacent to the upper side of said lower reach.

13. The apparatus of claim 1, wherein said source includes a nozzle which directs said current against said concave surface and has an outlet which discharges the current in a direction which is at least substantially parallel to the adjacent portion of said surface.

* * * * *